United States Patent [19]

Kuna et al.

[11] 4,227,335

[45] Oct. 14, 1980

[54] GRAPHIC ART TOY

[75] Inventors: Wayne A. Kuna, Elmhurst; Rouben T. Terzian, Chicago, both of Ill.

[73] Assignee: Marvin Glass & Associates, Chicago, Ill.

[21] Appl. No.: 1,179

[22] Filed: Jan. 5, 1979

[51] Int. Cl.[3] ..... A63H 33/00; A63H 13/00; D05C 5/00; D05C 15/06

[52] U.S. Cl. ..... 46/1 R; 46/116; 112/80; 112/266.1

[58] Field of Search ..... 46/1 R; 35/27, 28; 40/437, 19.5; 273/157 R, 159; 156/72; 112/79, 80, 266.1, 266.2

[56] References Cited

U.S. PATENT DOCUMENTS

| | | | |
|---|---|---|---|
| 313,710 | 3/1885 | Connett | 112/80 |
| 1,477,430 | 12/1923 | Creighton | 112/80 |
| 2,603,485 | 7/1952 | Countryman | 46/1 R |
| 2,636,460 | 4/1953 | Seiderman | 112/79.5 |
| 3,240,176 | 3/1966 | Morrison | 112/80 |
| 3,545,658 | 12/1970 | Tanemura | 112/266.1 |
| 3,570,435 | 12/1971 | Morrison | 112/266.1 |

*Primary Examiner*—Gene Mancene
*Assistant Examiner*—Michael J. Foycik, Jr.
*Attorney, Agent, or Firm*—Mason, Kolehmainen, Rathburn & Wyss

[57] ABSTRACT

The present invention relates to a graphic arts toy wherein a flexible string may be selectively attached at a wide variety of points around an exposed display surface to portray any desired pictorial representation and wherein the string may be quickly and easily stripped from the display surface after use and stored for futher use.

16 Claims, 9 Drawing Figures

GRAPHIC ART TOY

BACKGROUND OF THE INVENTION

1. Field of the Invention

The present invention relates to graphic arts toy and more particularly to an improved graphic arts toy which may be easily and repeatedly manipulated by a child in order to graphically portray a variety of pictorial representations.

2. Brief Description of the Prior Art

In the past, many graphic art toys have been proposed for the entertainment and amusement of children as well as for fostering their interest and experience with art. These devices range from the very simple type in which a plurality of numbered dots are interconnected in order to form a recognizable drawing to very sophisticated types in which a number of cams and gears interact with one another to form a specific geometric figure. Many devices of this type often require a great degree of coordination which children do not normally acquire until reaching school age. In addition, the use of indelible markers for these devices would make them undesirable for small children. The present invention therefore provides a graphic art toy which utilizes a reuseable line or string as the medium for constructing the art work.

SUMMARY OF THE INVENTION

It is an object of the present invention to provide an improved graphic arts toy of the character described which is of low cost construction and is easy to use.

It is another object of the invention to provide an improved graphic arts toy of the character described wherein string may be selectively attached at a wide variety of points around an exposed display surface to portray any desired pictorial representation and wherein the string may be quickly and easily stripped from the display surface after use and stored for reuse.

The present invention provides a graphic art toy including a display base and a string feedout and storage mechanism which is utilized to construct a design or other artistic creation on the display base. The string feedout and storage mechanism is generally in the form and shape of a spider and includes an internal spool for winding and storing the line and a nozzle or beak portion for removably connecting the line to predetermined positions on the display base. The display base is generally hexagonal in shape and includes a plurality of apertures each including resilient means for frictionally receiving and retaining a section of the line from the beak so that a graphic construction of the line can be made on the base by interconnecting any number of apertures with the string. A winding mechanism is provided for mounting the string feedout and storage mechanism and rewinding the line onto the internal spool.

The invention, both as to its organization and method of use will best be understood by reference to the following specification, taken in connection with the accompanying drawings, in which:

DESCRIPTION OF THE PREFERRED EMBODIMENT

Figure 1:
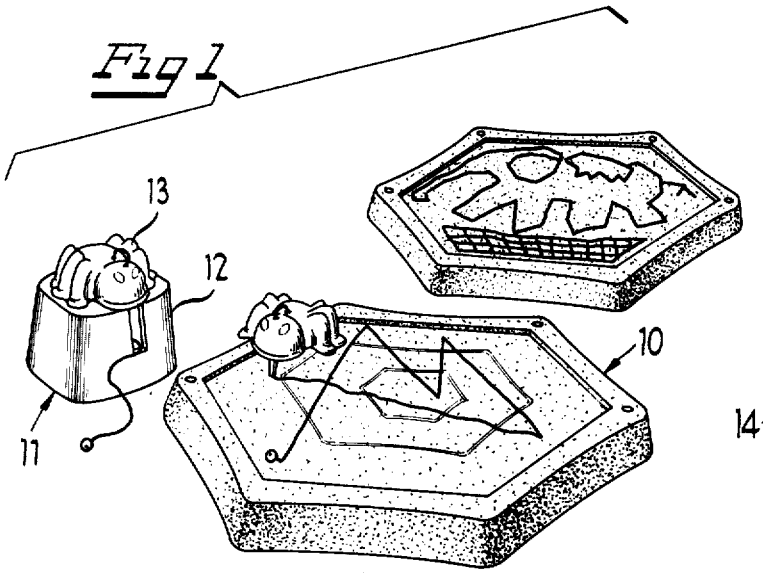
FIG. 1 is a view in perspective illustrating one embodiment of the present improved graphic arts toy.

Referring now to the drawings and more particularly to FIG. 1 thereof, the present invention is illustrated in its embodiment in a graphic arts toy which comprises a display base 10 and a string feedout and storage mechanism 11 made up of a hollow base 12 and a string storage and feedout unit 13 which is adapted to be detachably mounted upon the base 12. In its preferred embodiment and as shown in section in FIG. 7 of the drawings, the display base is of two-part construction in that it is made up of a reverse cup-shaped member 14 formed of a hard plastic material and a top part 15 formed of a relatively soft and resilient vinyl plastic material. More specifically, the top portion 14*a* of the base member 14 is recessed downwardly from the top thereof to provide a sunken upper wall part 14*b* to which the soft vinyl top part 15 is adhesively secured throughout the engaged surfaces thereof. Thus, the upper wall of the base 10 comprises an upper exposed part 15 of flexible resilient material having an upper exposed surface 15*a* and a non-exposed wall part 14*b*. This composite top wall is provided with a plurality of spaced openings 16 which extend at least partially through the wall and serve as anchor points for string fed onto the exposed top surface 15*a* in the manner more fully explained below.

Figure 7:
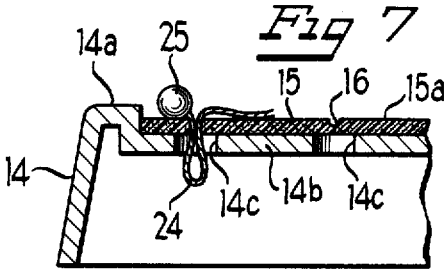
FIG. 7 is a partial sectional view of the display base shown in FIG. 2.

In the base form illustrated in FIG. 7 of the drawings, the top wall part 15 is provided with a regular pattern of small punched openings 16 therethrough which are geometrically positioned in straight lines to form a six-sided pattern. Beneath these openings, the non-exposed wall part 14*b* is provided with larger punched registering openings 14*c* which are adapted to receive string loops pressed through the top wall part 15 in the manner more fully explained below. If desired, the base member 14 may be provided with openings 17 which permit screw anchoring of the base to a table top or the like or to provide storage for the beak 13*a*. Also, decorative ridges or depressions 18 may be press formed in the top part 15 in order to enhance the pleasing appearance of the exposed top part surface 15*a*.

Figure 2:
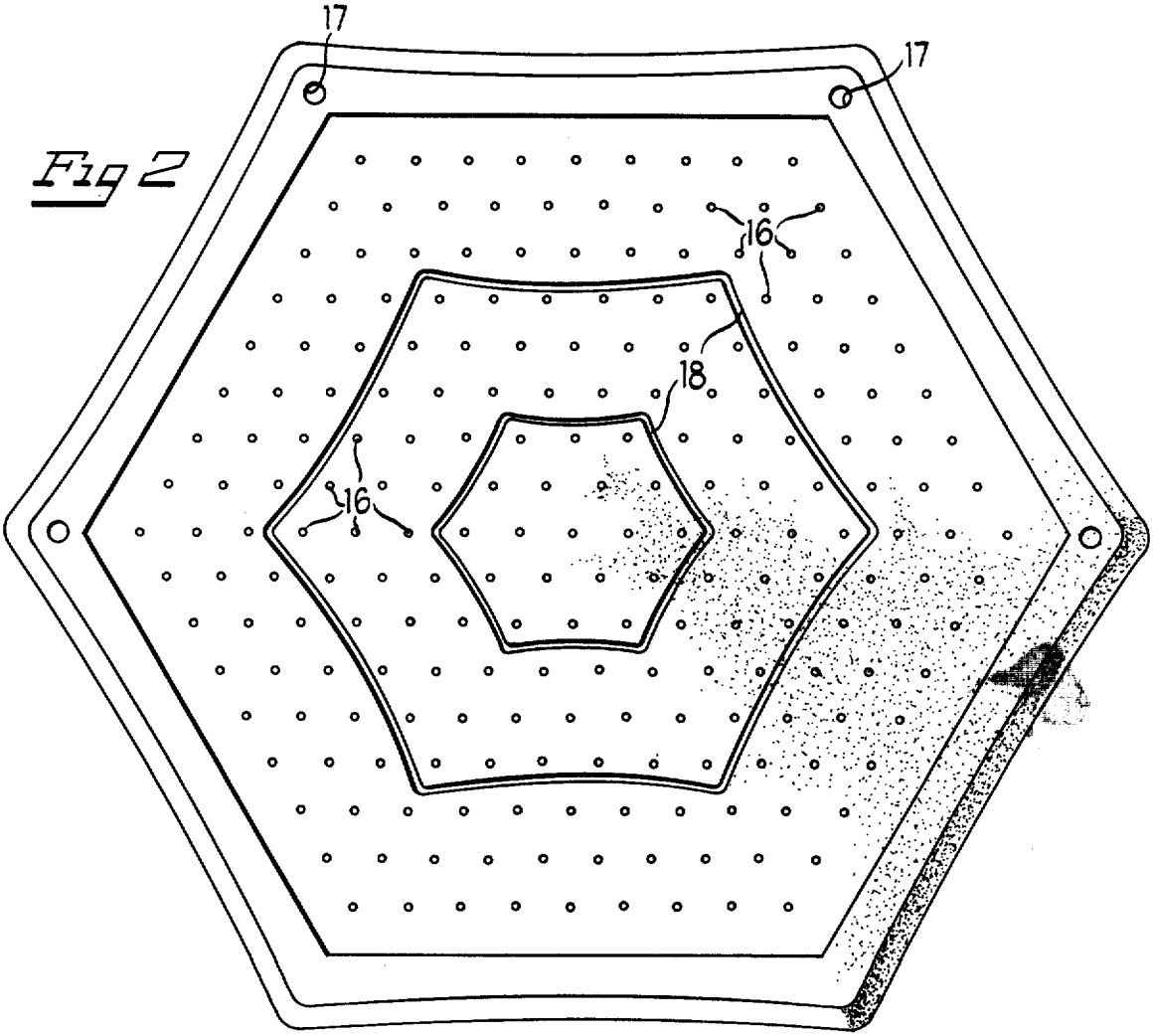
FIG. 2 is a top view of the base portion of the toy shown in FIG. 1.
Figure 3:
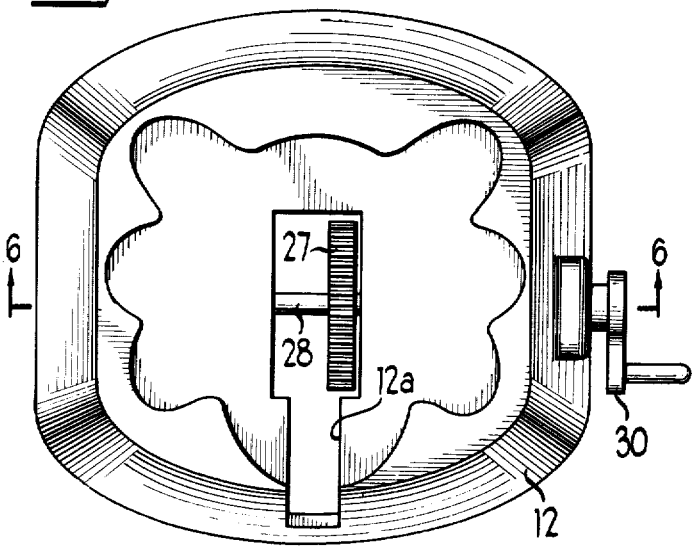
FIG. 3 is a top view of the rewind base forming a part of the string feedout storage mechanism embodied in the toy.
Figure 8:
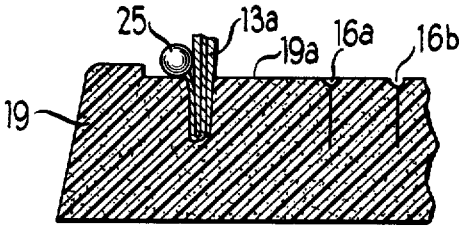
FIGS. 8 and 9 are partial sectional view illustrating an alternate form of the display base shown in FIG. 2.
Figure 9:
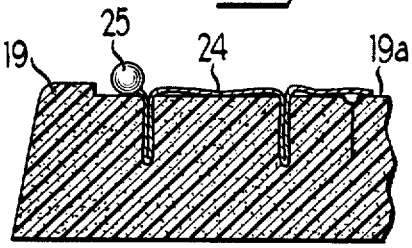

In the alternative form of base 10 illustrated in FIGS. 8 and 9 of the drawings, a one-piece base member 19 is provided which is formed of a dense molded skinned foam material. The member 19 is provided with a recessed top surface 19*a* on which the patternized openings 16*a* are formed. More specifically, these openings extend only partially through the thickness of the base member 19 and may be formed by a single needle array press piercing operation. Preferably, each opening is dimpled slightly as exemplified by the dimple 16*b* in FIG. 8, at the top surface 19a of the base member in order to facilitate the insertion of string into the openings 16a. The configuration of the base member 19 and the pattern of the openings 16a may be the same as those illustrated in FIG. 2 of the drawings.

The details of the string storage and feedout unit 13 will best be understood by reference to FIGS. 3, 4, 5 and 6 of the drawings. Briefly, this unit comprises a housing shell consisting of the hollow base part 12 having the hollow top part 13 detachably supported thereon. Preferably, the top part is externally contoured to simulate the appearance of a small animal or insect, such as a spider. The top part 13 is contoured to seat snugly within the depressed top wall of the base 12.

Within the top part 13, a string spool 20 is provided which is mounted for rotation with a rewind pinion 21 on a rotatable shaft 22. The shaft 22 is journaled at its respective ends in bearing openings formed at the tips of spaced apart legs 23a and 23b which extend downwardly and are formed integrally with the upper wall of the top part 13.

Figure 4:
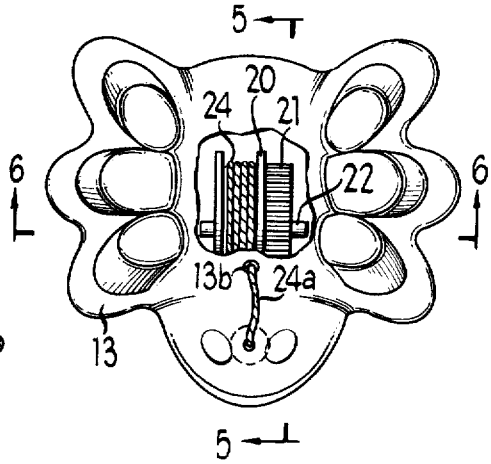
FIG. 4 is a top view, partially cut away, illustrating the animated string storage and feedout unit which during non-use sits on top of the base shown in FIG. 3.
Figure 5:
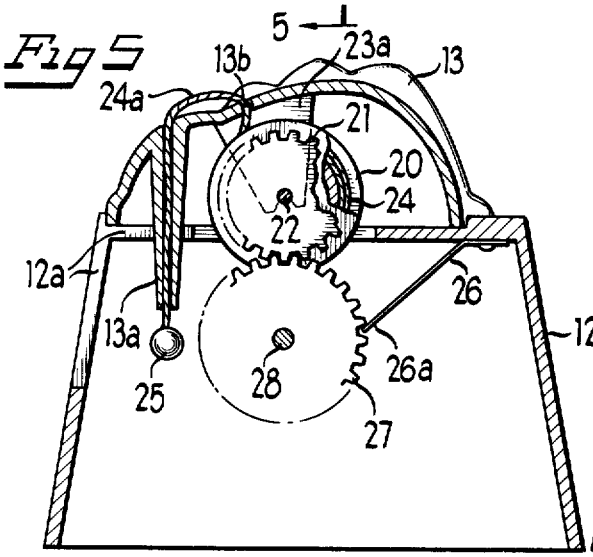
FIG. 5 is a sectional view taken along the lines 5—5 of FIGS. 3 and 4 when the unit of FIG. 4 is resting on the top of the base shown in FIG. 3.
Figure 6:
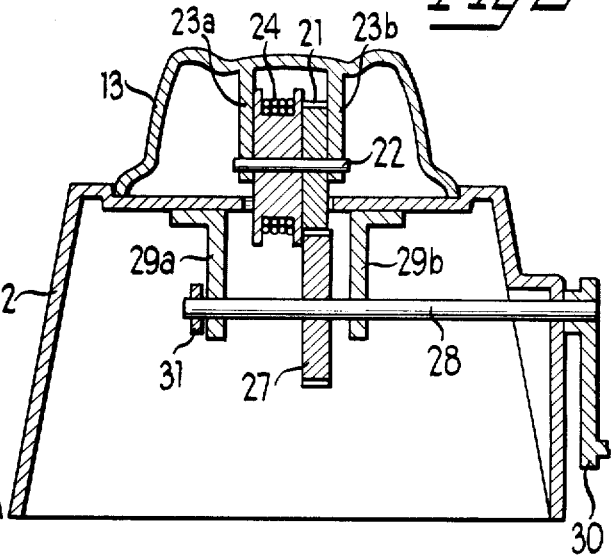
FIG. 6 is a sectional view taken along the lines 6—6 of FIGS. 3 and 4 when the unit of FIG. 4 is resting on the top of the display base shown in FIG. 3.

As best shown in FIGS. 4, 5 and 6 of the drawings, the spool 20 carries and stores a length of string 24 the inner end of which is fixedly attached to the core of the spool 20 and the loose end of which is fixedly connected to a stop ball 25. Intermediate its ends, the string 24 traverses the bore of a hollow punch-like beak 13a which is formed integrally with the top part 13 and extends downwardly into the interior of the base 12 through a relatively wide slot 12a formed in the top and side walls of the base 12. After passing through the bore of the beak 13a, the string 24 re-enters the interior of the top part 13 for reception by or delivery from the spool 20 through an opening 13b formed in the top part 13. Thus, that portion 24a of the string 24 which extends between the opening 13b and the entry opening to the bore of the beak 13a simulates an animated or movable nose on the animal or insect which the top part 13 is contoured to represent.

In order to wind the string 24 onto the spool after use and with the top part 13 supported upon the base 12, a manually operable rewind mechanism is provided which comprises a pinion gear 27 mounted for rotation with a crank actuated shaft 28 and engageable with the pinion gear 21. A ratchet means is provided by a spring 26 secured to the underside of the base as shown in FIG. 5. The end 26a of the spring 26 contacts the gear teeth 27 to permit rotation and thus rewinding of the string 24 in one direction only. More particularly, the shaft 28 is journalled in bearing brackets 29a and 29b which depend from the top wall of the base 12 and at its outer end extends through an opening in the side wall of the base 12. A crank 30 is fixedly mounted upon the outer end of the shaft 28 to impart rotation to the pinion gear 27. A stop ring 31 is mounted upon the inner end of the shaft 28 to restrain the shaft assembly against longitudinal movement.

A child using the above-described graphic arts toy will first remove the top part 13 and the components supported thereby from the base 12 and place the same on the exposed top surface 15a of the base 14 with the lower end of the beak 13a and the opposite lower side edge of the top part 13 preferably in light engagement with the surface 15a. Upon selecting a starting hole or opening 16 in this surface, the end of the beak 13a is pushed through the hole and then retracted. When this is done, the string 24 is pushed through the selected opening in the wall part 15 and the registering opening 14c located therebelow. As the beak 13a is retracted, the walls of the opening in the resilient material forming the top wall part 15 contract to grip the string segments therewithin and leave a string loop within the opening 14c, all as best shown in FIG. 7 of the drawings. As will be understood, the presence of the ball 25 on the end of the string 24 prevents the string end from being pushed through the starting opening 16. Thus, the string end is anchored in the selected starting opening 16.

To form the desired pictorial representation on the exposed surface 15, the unit 13 is moved away from the starting hole or opening 16 to position the beak 13a over a selected second hole where the beak punching operation is repeated, thereby to produce a taut string segment which interconnects the selected starting and second holes. By repeating this operation on a selected hole to hole basis, the desired pictorial representation is gradually developed on the exposed display surface by the taut string segments, all in the manner best shown in FIG. 1 of the drawings.

During movement of the beak 13a from hole to hole over the surface 15a, the string 24 is obviously unwound from the spool 20 and withdrawn from the top part 13. Such withdrawal of the string 24 causes clockwise rotation of the spool 20.

When it is desired to erase the pictorial representation from the display surface 15a, all that need be done is to strip the string 24 from the holes 16 in the inverse order of the strings placement within these holes. This permits the used holes 16 to contract to their normal small size in readiness for further use.

In order to respool the used length of string resulting from the erasing operation, the top part 13 is positioned in its resting position on top of the base 12 to bring the pinion gear into driving engagement with the pinion gear 27. The crank 30 is then rotated to drive the gear 27 in a clockwise direction as viewed in FIG. 5 of the drawings, thereby to rotate the pinion gear 21 and spool 20 in the opposite direction and thus draw the string 24 into the top part 13 through the beak 13a and the opening 13b for respooling and storage on the spool 20. After the string 24 is fully rewound on the spool 20, the ball 25 engages the end of the beak 13a to stop rotation of the spool and thus signal the operator that the respooling operation is completed.

The mode of using the toy when the alternative base structure illustrated in FIGS. 8 and 9 of the drawings is used is exactly the same as explained above and will be fully explained above and will be fully apparent from the foregoing explanation.

While there have been described what are presently considered to be the best modes of practicing the invention, it will be understood that various modifications may be made therein which are within the true spirit and scope of the invention as defined in the appended claims.

We claim:

1. A graphic arts toy, comprising:

a base;

a wall on the base provided with an exposed surface, said wall having a flexible substrate and being provided with a plurality of openings extending from said surface at least partially into said substrate and positioned in spaced apart relationship around said surface to form a variety of graphic patterns;

an elongated flexible string adapted to be pushed into said openings at spaced intervals to form loops entirely within said substrate and thus interconnect selected ones of said openings to form a graphic pattern on said surface; and means for storing and dispensing said elongated flexible string including a housing shell which is manually movable over the exposed surface of said wall, spool means rotatably mounted within the housing for feeding said string and manually actuatable means on the exterior of said housing for engagement by the user to rotate the spool in a direction to store the string on the spool within the housing.

2. A graphic arts toy as claimed in claim 1, wherein said base includes the wall on the relatively flexible resilient substrate on which said exposed surface is provided and a non-exposed part of relatively hard non-resilient material.

3. A graphic arts toy as claimed in claim 2, wherein said openings extend through said substrate and said non-exposed part of said wall is provided with larger openings therethrough which register with and overlie the openings to facilitate insertion of the string thereinto and therethrough.

4. A graphic arts toy as claimed in claim 1, wherein said housing comprises a base part and a top part and wherein said top part is provided with a pair of spaced openings therein for feeding string from said rotatable spool to the exterior of said housing shell and then back into the interior of said base part.

5. A graphic arts toy as claimed in claim 3, wherein said spool means is provided for storing said string in spooled storage and for feeding said string out to permit insertion thereof and includes feeding means for inserting looped segments through the openings extending through the exposed part of said wall and into the larger openings in the non-exposed part of said wall.

6. A graphic arts toy as claimed in claim 5, wherein said feeding means comprises a hollow beak through which said string is fed onto said exposed surface and which is adapted to be finger manipulated to punch said string into selected ones of said openings.

7. The graphic arts toy of claim 1 wherein said manually operable means on the exterior of said housing comprises gear means for rotating the same.

8. The graphic arts toy of claim 7 including crank means selectively engageable with said gear means for winding the string onto said spool.

9. The graphic arts toy of claim 8 wherein said housing is in the form and shape of a spider and includes an elongated hollow beak through which said string is fed to insert the loops into selected ones of said openings.

10. The graphic arts toy of claim 9 including means for permitting rotation of said crank means in only one direction.

11. The graphic arts toy of claim 10 wherein said means comprises a ratchet formed by a spring engaging said crank means to prevent rotation of the crank in one direction.

12. A graphic arts toy as claimed in claim 11, wherein said housing is provided with a tapered hollow beak into which said string is fed through one of said openings and from which said string is adapted to be fed onto said exposed surface, said beak being adapted to be finger manipulated to punch said string into selected ones of said openings.

13. The graphic arts toy of claim 1 said base includes support means for elevating the substrate to a plane parallel and spaced from a suitable supporting surface.

14. The graphic arts toy of claim 1 wherein said openings are defined in said wall by a countersunk dimple adjacent the surface and a substantially longer slit within the substrate.

15. The graphic arts toy of claim 1 wherein said housing is in the form and shape of a spider and includes an elongated hollow beak through which said string is fed to insert the loops into selected ones of said openings.

16. The graphic arts toy of claim 15 including means for rewinding the string onto the spool comprising a hollow housing receiver having means thereon complementary with the shape of said housing for receiving the same and aligning said manually actuatable means on the housing with a crank means on the receiver, said crank means being manually operable by the user to rewind the string onto the spool.

* * * * *